United States Patent [19]

Kobayashi

[11] 3,985,381

[45] Oct. 12, 1976

[54] LOCKING APPARATUS PROVIDED WITH AN IDLE MECHANISM

[75] Inventor: Fumio Kobayashi, Yokohama, Japan

[73] Assignee: Ohi Mfg. Co., Ltd., Yokohama, Japan

[22] Filed: Oct. 17, 1975

[21] Appl. No.: 623,384

[30] Foreign Application Priority Data

Oct. 23, 1974 Japan ..... 49-127422

[52] U.S. Cl. ..... 292/216; 292/280; 292/DIG. 26; 292/DIG. 43

[51] Int. Cl.[2] ..... E05C 3/06

[58] Field of Search ..... 292/216, 280, DIG. 14, 292/DIG. 43, DIG. 26, DIG. 27; 70/240, 256

[56] References Cited

UNITED STATES PATENTS

| | | | |
|---|---|---|---|
| 2,777,719 | 1/1957 | Jeavons | 292/280 |
| 2,777,720 | 1/1957 | Roethel | 292/280 |
| 2,877,038 | 3/1959 | Kramer | 292/216 |
| 3,016,968 | 1/1962 | Lenz et al. | 70/256 |
| 3,178,212 | 4/1965 | Leslie | 292/280 |
| 3,201,164 | 8/1965 | Griswold | 292/280 |
| 3,785,186 | 1/1974 | James et al. | 70/240 |

*Primary Examiner*—Robert A. Hafer
*Attorney, Agent, or Firm*—Zarley, Mckee, Thomte, Voorhees & Sease

[57] ABSTRACT

A locking apparatus provided with an idle mechanism for preventing an erroneous unlocking operation inside the vehicle or a possible car theft. The apparatus is comprising a pivotally mounted latch member engageable with a striker, a locking plate pivotally mounted on a common pivot to receive the latch member, and a releasing lever which is also pivotally mounted on the common pivot and may be shifted from an unlatching position to a free position, whenever necessary, so as to cause the releasing lever not to work upon the locking plate any longer and to retain the completely latched-condition.

6 Claims, 4 Drawing Figures

LOCKING APPARATUS PROVIDED WITH AN IDLE MECHANISM

Figure 2:
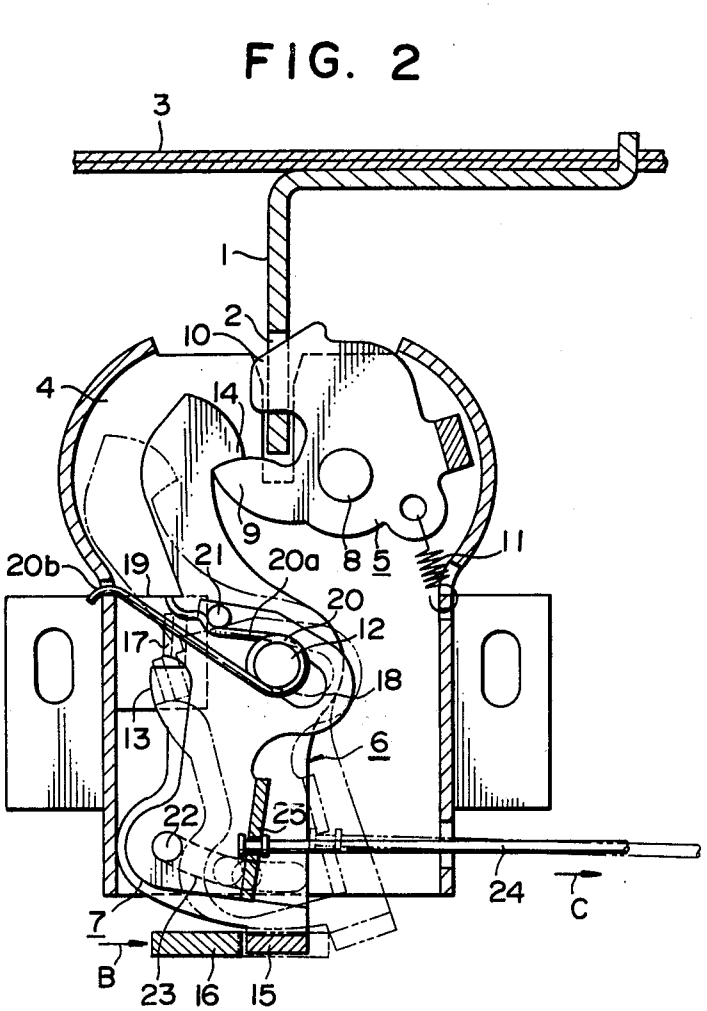

The present invention generally relates to locking apparatus provided with an idle mechanism, and has a particular application, though not exclusive by any means, to locking apparatus provided with an idle mechanism for trunk lids of motor vehicles or the like, which is particularly advantageous for avoiding a mistaken unlocking operation or preventing a possible car theft.

Heretofore, various kinds of locking apparatus with an idle mechanism have been proposed for various purposes. However, as any one familiar with the prior art will recognize, none of those locking apparatus has every been applied to trunk lids of motor vehicles, because the prior art apparatus are generally mounted on the central portion of the trunk lids, and therefore can not afford to have enough space for an attachment of an idle mechanism.

Furthermore, it has been a practice in the well known apparatus for trunk lids that a striker is fixed to the vehicle body while a much-space-occupying latch member is directly mounted on the trunk lid, due to which it has been technically difficult for a person skilled in the art to install an idle mechanism within the locking apparatus.

According to the present invention, a locking apparatus with an idel mechanism installed therein has, contrary to the prior art, a striker mounted possibly on any portion of a trunk lid, preferably on the side portion thereof, and has a latch member mounted on the corresonding portion of a vehicle body so as not only to obtain enough space for installment of the idle mechanism, but also to reduce the damage to the trunk lid to a minimum.

In order to close the trunk lid, both said striker and said latch member are brought into a constant engagement with each other, during which a locking plate is also positioned for the receiving of the latch member to secure the latched condition.

In the locking apparatuss according to the present invention, there are also provided a key-operatable plate to effect a direct release of the latch member from outside the vehicle, and a releasing lever which acts upon the locking plate to effect the internal release of the latch member, i.e., releasing the latch member from inside the vehicle, by pulling an operating rod connected to the releasing lever. The locking aparatus comprising such mechanism mentioned above can install an idle mechanism threin, which eventually distinguishes the present invention from the known apparatus similar to this.

A person may easily put the idle mechanism under the ready condition to work, whenever necessary, by manually having the releasing lever off its position where it is acting upon the locking plate. Thus, it will be possible to prevent an erroneous unlatching operation inside the vehicle and to take precaution of a possible car theft.

Figure 1:
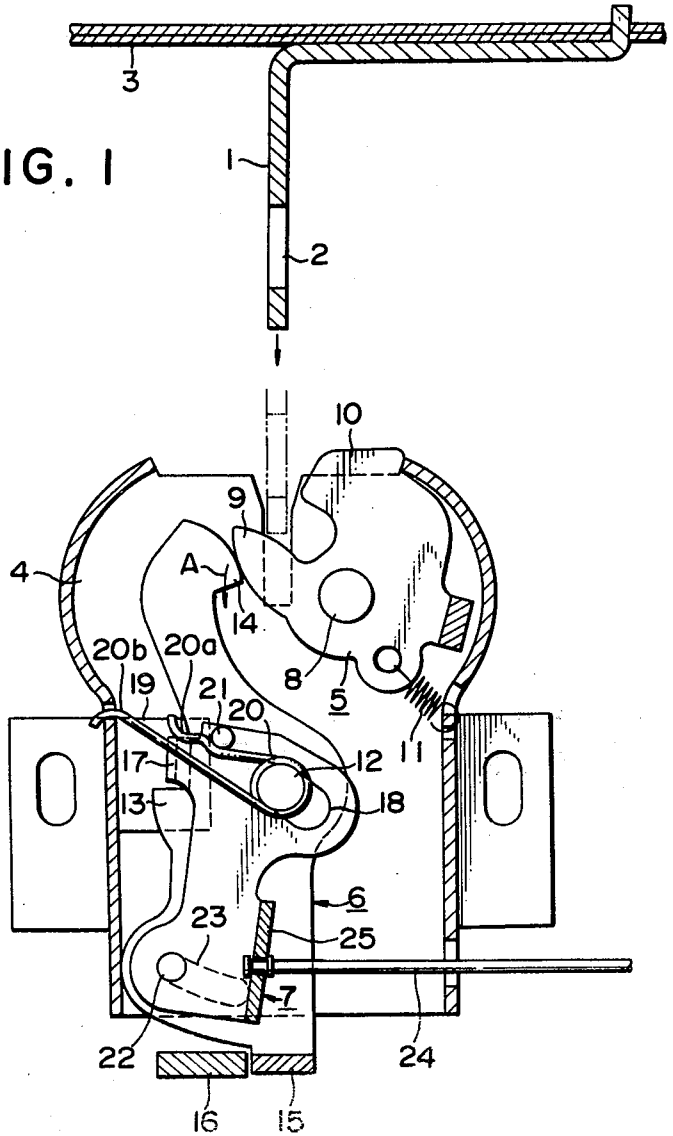

The above and other objects, features and advantages of the present invention will be more apparent from the following detailed description of illustrative embodiments when taken in conjunction with the accompanying drawings, in which:

FIG. 1 shows a vertical cross sectional front view of a locking apparatus having an idle mechanism in accordance with the present invention.

FIG. 2 similarly shows a vertical cross sectional front view of the same, when a striker is in engagement with a latch member.

Figure 3:
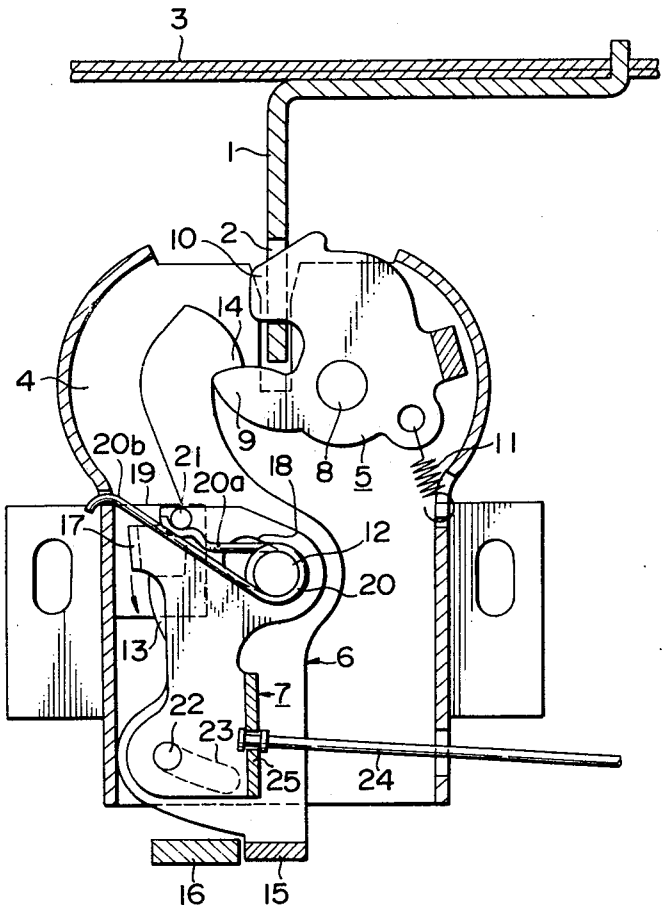

FIG. 3 shows similarly a vertical cross sectional front view of the same, when a releasing lever is so positioned as to have an idle mechanism ready to work.

Figure 4:
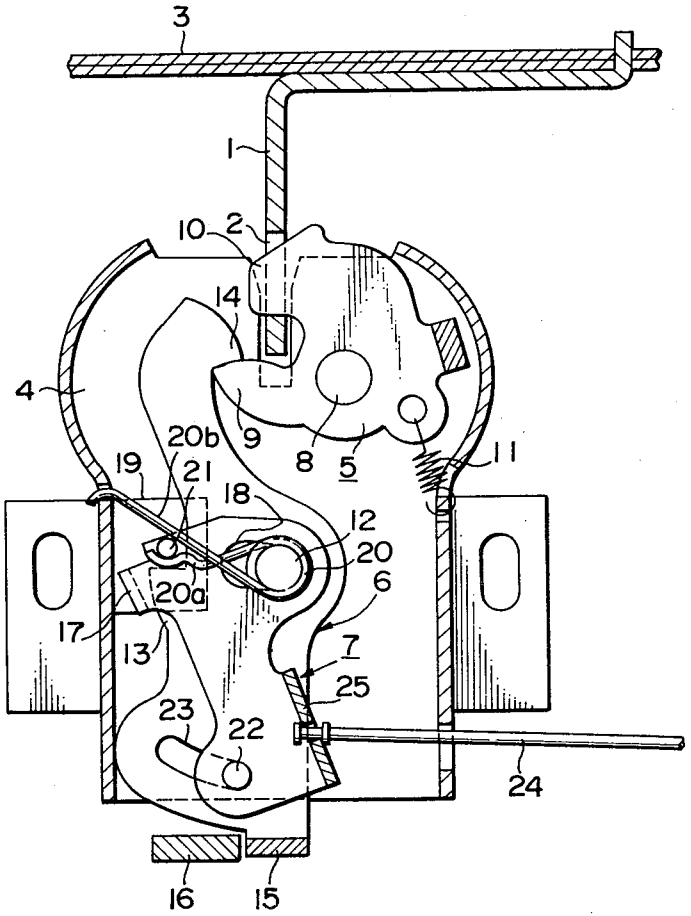

FIG. 4 similarly shows a vertical cross sectional front view of the same, when an idle mechanism is working.

An angular shaped striker 1, having an aperture 2 disposed at its lower end portion, is solidly mounted on the underside of a trunk lid. 3.

Fixed to a vehicle body is a body plate 4, within which a latch member 5, a locking plate 6 and a releasing lever 7 are suitably arranged. The latch member 5, pivotally mounted on the body plate 4 by a pivot 8 is consisting of an engagement member 9, with which the bottom edge of the striker 1 engages so as to turn the latch member 5 counter-clockwise to acheive the lid closure, and a locking leg 10 engageable with the aperture of the striker 1 when the latch member 5 being pivotted counter-clockwise. There is provided a tension spring 11 biasing the latch member 5 to a clockwise direction.

At an almost central portion of the body plate 4, the locking plate 6 is pivotally mounted by a common pivot 12, having an engaging portion 13 disposed at the left side thereof, a hook 14 at the upper portion thereof which, at the same time when the locking leg 10 of the latch member 5 engages with the aperture 2 of the striker 1, can engage with the engagement member 9, and a flange-like member 15 disposed at its utmost bottom to enable a key-operatable plate 16 operatable outside the vehicle to push and move the locking plate 6 to cause a disengagement of the locking plate 6 from the latch member 5.

There is also provided a releasing lever 7 having a rearwardly bent-up flange 17 at its left upper portion which is engageable with the engaging portion 14 of the locking plate 6 when the releasing lever 7 being pivotted counterclockwise.

This releasing lever 7 also has a slot 18 laterally extending through which the common pivot 12 is passing, and is pivotally mounted by that pivot 12 at the left side of the slot 18 in such a manner as to be in the front position of the locking plate 6. The bent-up flange 17 is rearwardly protruding through an opening 19 of the body plate 4 for the purpose which will be described hereinafter in more detail.

A torsion spring 20, one end **20*a* of which is supported by an anchorage 21 of the releasing lever 7 while the other end 20*b* being hooked on the body plate 4, surrounds the common pivot 12 so as to continously apply a clockwise turning moment onto the releasing lever 7**.

Further, a rearwardly extending pin 22, welded on the lower end portion of the releasing lever 7, is passing through an arcuate slot 23 of the locking plate 6 and is constantly positioned in enegagement with the left edge of the arcuate slot 23 having its center on the axis of the common pivot 12.

An operating rod 24, operatable from inside the vehicle is connected to a forwardly bent-up flange 25 disposed on a edge of the releasing lever 7.

In operation, when closing the trunk lid 3, the bottom edge of the striker 1 hits the engagement member 9, urges it downward (as shown by an arrow A in FIG. 1) and consequently has the latch member 5 turn about the pivot 8 against the tension spring 11 is an anti-clockwise direction.

Once the complete closure of the trunk lid 3 is achieved, the locking leg 10 of the latch member 5 goes into the aperture 2 and is in tight engagement with it. Simultaneously, while the striker 1 is pressing the engagement member 9 downward as mentioned above, said engagement member 9 is also forcing the locking plate 6 to turn about the common pivot 12 against the torsion spring 20.

No sooner is the engagement member 9 pressed downward to the utmost than the locking plate 6 returns to its original position, by means of the torsion spring 20, where the hook 14 of the locking plate 6 and the engagement member 9 of the latch member 5 are now in engagement with each other to accomplish the completely latched-condition, as shown in FIG. 2.

On the other hand, when the lateral force in the direction shown by an arrow B in FIg. 2 is applied to the flange-like member 15 of the locking plate 6 by virtue of the key-operatable plate 16, the locking plate 6 is turned about the common pivot counterclockwise against the torsion spring 20. Then, a disengagement of the hook 14 of the locking plate 6 from the engagement member 9 of the latch member 5 takes place to open up the trunk lid 3. When moving upward the striker 1 together with the trunk lid 3, the latch member 5 returns to its normal position through the tension spring 11 to achieve the complete closure.

There is also another way of releasing the latch. When the operating rod 24 connected to the forwardly bent-up flange 25 is pulled toward the direction as shown by an arrow C in FIG. 2 from inside the vehicle, the releasing lever 7, having its pivot on 12, turns anti-clockwise against the torsion spring 20. In this instance, soon after the pin 22, disposed at the lower end portion of the releasing lever 7 and passing through the arcuate slot 23 of the locking plate 6, starts to move along the slot 23 toward the pulled direction of the rod 24, the rearwardly bent-up flange 17 of the releasing lever 7 is shifted to the position where it is received by the engaging portion 13 of the locking plate 6. Immediately after that, the rearwardly bent-up flange 17 turns the locking plate 6 counter-clockwise.

It will be thus understood that the engagement member 9 becomes free from an engagement with the hook 14 of the locking plate 6, so as to open up the trunk lid 3 in the same way as mentioned before.

In order to provide an idle mechanism for such a locking apparatus, all what a person should do is simply to pull the rearwardly bent-up flange 17 to the left hand to shift the releasing lever 7 so far as where the common pivot 12 fixed on the locking plate 6 is now located at the extreme right side of the slot 18 of the releasing lever 7. A person may easily pull the flange 17, since the flange 17 is projecting through the opening 19 of the body plate 4 toward the trunk room of the vehicle and is operatable outside the vehicle when the trunk lid is open. Thus, it will be understood that to set the releasing lever 7 not to work upon the locking plate 6 is an entirely simple operation.

In other words, even if a person pulls the operating rod 24 toward an arrow C direction to turn the releasing lever 7 counterclockwise, the rearwardly bent-up flange 17 does no longer engage with the engaging portion 13, as is illustrated in FIG. 4. In this case, as can be realized, the engagement member 9 of the latch member 5 is retained in a constant engagement with the hook 14 of the locking plate 6.

Thus, it will be understood that a person inside the vehicle may easily avoid an erroneous operation of the operating rod 24, and can prevent a possible car theft.

Although the illustrative embodiments of the present inventin have been described in detail with reference to the accompanying drawing, it should be understood that the invention is not limited to those embodiments by any means, and that various changes and modifications may be inferable without departing from the scope and spirit of the present invention.

What we claim is:

1. A locking apparatus provided with an idle mechanism for lids comprising:

a striker firmly fixed to a lid, having an aperture at the lower portion thereof, a latch member, pivotally mounted on a body plate, having an engagement member engageable with the bottom edge of said striker and a locking notch engageable with said aperture of said striker, a locking plate, also pivotally mounted on said body plate by means of a common pivot, having an engageable portion, a hooking member to receive said engagement member of the latch member during lid closure, and a flange member thereby enabling a key-operatable plate to push the locking plate in an unlatching direction, and a releasing lever, pivotally mounted on the body plate by means of said common pivot which is passing through a laterally extending slot disposed at the upper portion of the releasing lever and is usually positioned in engagement with one end of said slot, having a projecting member protruding through an opening of the body plate and a means to turn the releasing lever, whereby it becomes possible to shift the releasing lever to have the said common pivot positioned in engagement with the other end of the said slot so as to cause the releasing lever to disengage with the locking plate irrespectively of the operation of said means.

2. A locking apparatus provided with an idle mechanism according to claim 1, wherein a biasing means is disposed so as to continuously give a clockwise turning moment to said latch member.

3. A locking apparatus provided with an idle mechanism according to claim 1, wherein another biasing means is disposed to continously give a clockwise turning moment to said releasing lever.

4. A locking apparatus provided with an idle mechanism according to claim 1, wherein an arcuate slot, having its center on said common pivot, is disposed at the lower end portion of said locking plate so as to allow said releasing lever to turn about said common pivot freely without said projecting member of the releasing lever in engagement with said engaging portion of the locking plate while the releasing lever being shifted from an usual position.

5. A locking apparatus provided with an idle mechanism according to claim 1, wherein said projecting member of the releasing lever can be operated outside the vehicle.

6. A locking apparatus provided with an idle mechanism according to claim 1, wherein said means to turn the releasing lever may be a rod which can be operated within inside the vehicle.

* * * * *